United States Patent [19]

Barozzi et al.

[11] Patent Number: 4,527,922

[45] Date of Patent: Jul. 9, 1985

[54] FEED ROLLER DEVICE OF TYPEWRITER

[75] Inventors: Gian P. Barozzi; Giancarlo Horeschi, both of Tokyo, Japan

[73] Assignee: Tokyo Juki Industrial Co., Ltd., Tokyo, Japan

[21] Appl. No.: 637,526

[22] Filed: Aug. 3, 1984

Related U.S. Application Data

[63] Continuation of Ser. No. 523,754, Aug. 16, 1983, abandoned, which is a continuation of Ser. No. 287,625, Jul. 28, 1981, abandoned.

[30] Foreign Application Priority Data

Aug. 11, 1980 [JP] Japan ..... 55-110951

[51] Int. Cl.[3] ..... B41J 13/048

[52] U.S. Cl. ..... 400/637.5; 400/637.3

[58] Field of Search ..... 400/637, 637.1, 637.3, 400/637.4, 637.5, 637.6, 647

[56] References Cited

U.S. PATENT DOCUMENTS

| | | | |
|---|---|---|---|
| 1,062,569 | 5/1913 | McLaughlin | 400/637.6 |
| 1,453,577 | 5/1923 | Armstrong | 400/637.3 |
| 2,059,214 | 11/1936 | Dreher | 400/637.5 |
| 2,297,490 | 9/1942 | Martin et al. | 400/647 |

OTHER PUBLICATIONS

"Frame for Paper Feed Rolls"; R. H. Marowski et al; *IBM Technical Disclosure Bulletin,* vol. 14, No. 3; 8/1971; p. 905.

"Paper-Handling Apparatus for Typewriter & Printers"; R. J. Jenney et al; *IBM Technical Disclosure Bulletin,* vol. 20, No. 12; 5/1978; p. 5221.

"Paper Feed Mechanism"; E. R. Lloyd et al; *IBM Technical Disclosure Bulletin;* vol. 23, No. 2, pp. 678-679; Jul. 1980.

*Primary Examiner*—Edgar S. Burr
*Assistant Examiner*—David A. Wiecking
*Attorney, Agent, or Firm*—Koda and Androlia

[57] ABSTRACT

A feed roller device of a typewriter used for reliably urging a sheet of paper to be printed against a platen. In this feed roller device, a pair of feed roller assemblies are parallelly arranged in parallel to the axial line of the platen and rocking levers are provided at the central positions in the axial lines of the feed roller assemblies, respectively. Each of these two rocking levers is rockingly supported by a typewriter frame, pivotally supported at one end thereof by a connecting rod of one of the feed roller assemblies and provided at the other end thereof with a spring, which urges the feed roller assembly against the platen by the urging force thereof. Consequently, only two springs are used, so that the adjustment of the feed roller assemblies urging the platen in urging force can be facilitated.

4 Claims, 4 Drawing Figures

FEED ROLLER DEVICE OF TYPEWRITER

This is a continuation of application Ser. No. 523,754, filed Aug. 16, 1983, now abandoned, which is a continuation of Ser. No. 287,625 filed July 28, 1981, now abandoned.

BACKGROUND OF THE INVENTION

1. Field of the Invention

This invention relates to a feed roller device of a typewriter, and particularly to a feed roller device used for reliably urging a paper to be printed against a platen of a typewriter.

2. Description of the Prior Art

The conventional feed roller device of a typewriter has been such an arrangement that there are arranged in parallel a pair of feed roller assemblies each comprising: a front feed roller row including a plurality of rollers arranged on one and the same axial line; a rear feed roller row including a plurality of rollers arranged on an axial line in parallel to that of the front feed rollers; and arms for pivotally supporting opposite ends of rotary shafts of the aforesaid feed roller rows; and resilient members are provided on the four arms pivotally supporting the rotary shafts of the feed roller rows so as to urge the aforesaid feed rollers against the platen, and the feed rollers are urged against the platen by the urging forces of the resilient members. In the feed roller device of a typewriter, in order to prevent a sheet of paper from being distorted during paper feed, it is necessary to make uniform the urging forces of the feed rollers against the platen. Since there has been provided the resilient members on the four arms, respectively, in the feed roller device of the conventional typewriter as described above, the adjustment of the feed rollers in urging force is referenced from one of the resilient members, and other three resilient members should be adjusted to have resiliencies equal in value to this resilient member, thus resulting in a troublesome work for adjustment In general, in the feed roller device of the typewriter, it is necessary that, during setting of a sheet of paper into the typewriter, the feed roller device should be set off the platen However in the feed roller device of the conventional typewriter, the mechanism for this setoff operation is one in which the respective arms are directly rocked by the working rods, thereby presenting a disadvantage of rendering to the device a complicated construction.

SUMMARY OF THE INVENTION

The present invention has been developed to obviate the disadvantages in the feed roller device of the conventional typewriter and has as its object the provision of a feed roller device of a typewriter in which the adjustment of the feed rollers in urging force against the platen is easily made and a mechanism for setting the feed rollers off the platen is simplified in construction. The present invention can offer such characteristic features that the feed roller device comprises: a pair of feed roller assemblies parallelly arranged at positions where the feed roller assemblies can contact a platen pivotally supported on a typewriter frame, each of the feed roller assemblies including a first feed roller row consisting of a plurality of feed rollers arranged on one and the same axial line, a second feed roller row consisting of a plurality of feed rollers arranged on an axial line in parallel to that of the first feed rollers, arms for pivotally supporting opposite ends of rotary shafts of the aforesaid first and second feed roller rows, and connecting rods secured in parallel to the rotary shafts of the first and second feed roller rows across the arms; rocking levers rockingly supported on a typewriter frame, one end of each of which is pivotally supported on the aforesaid connecting rod at the central portion in the axial direction of the feed roller assembly and the other end of each of which is urged toward the platen by a resilient member; and a working rod formed with flat surfaces for abutting against the rocking levers and rotatably supported by the typewriter frame whereby it rocks the rocking levers against the resiliencies of the resilient members in directions in which the rocking levers leave the platen. In the feed roller device according to the present invention, connecting rods are provided across the arms of the feed roller assemblies, rocking levers pivotally supported on the connecting rods at the central portions in the axial directions of the feed rollers of the feed roller assemblies, and two resilient members for urging ends of the rocking levers toward the platen are provided on the rocking levers, thereby facilitating the adjustment of the resilient members in urging force to a considerable extent. Further, in the feed roller device according to the present invention, a working rod formed with flat surfaces for abutting against the aforesaid rocking levers in order to set the feed rollers off the platen is pivotally supported on the typewriter frame, and rotation of this working rod set the feed rollers off the platen against the urging forces of the resilient members, so that the setoff mechanism can be simplified in construction to a considerable extent.

BRIEF DESCRIPTION OF THE DRAWINGS

The abovedescribed and other objects, features and advantages of the present invention will become apparent more fully from the description of the following embodiment in conjunction with the accompanying drawings.

DETAILED DESCRIPTION OF THE INVENTION

Figure 1:
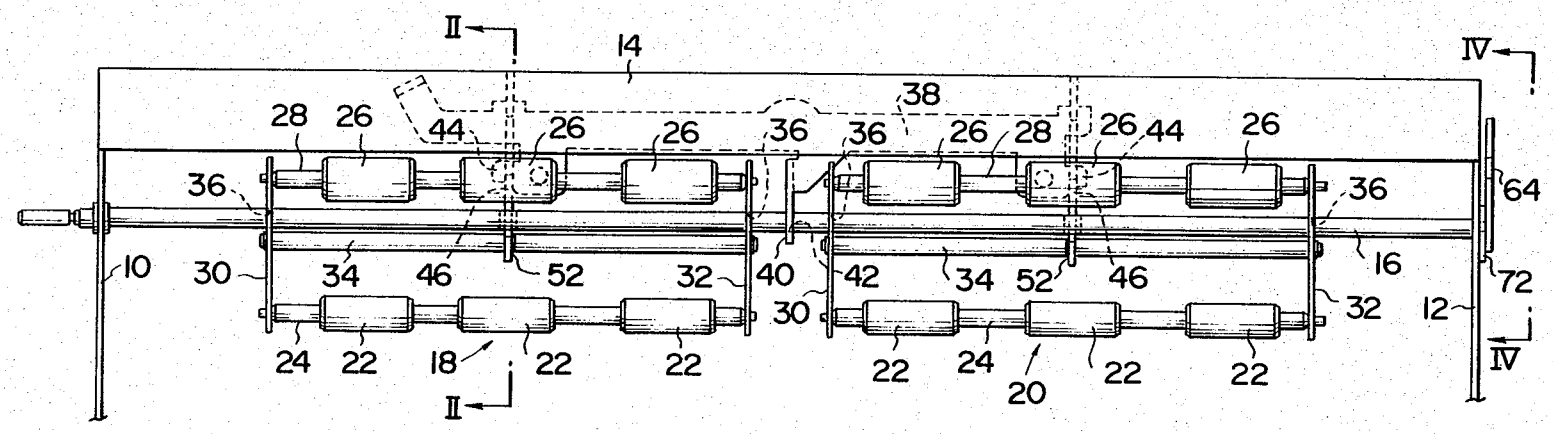
FIG. 1 is a plan view showing an embodiment of the present invention.

Detailed description will hereunder be given of the preferred embodiment of the feed roller device according to the present invention with refefence to the accompanying drawings. FIG. 1 is a plan view showing the feed roller device of the typewriter according to the present invention. In FIG. 1, there are shown side frames 10 and 12, which are connected to each other by a pipe frame 14 being rectangular in cross section. A working rod 16 to be described hereinafter is rotatably supported across the side frames 10 and 12.

FIG. 1 shows a pair of feed roller assemblies 18 and 20, which are arranged in parallel to the axial direction of a platen. Description will now be given of construction of the feed roller assemblies 18 and 20. A front feed roller row includes three small diameter feed rollers 22, 22 and 22, and a rotary shaft 24, on which are mounted these small diameter feed rollers 22, 22 and 22. A rear feed roller row includes three large diameter feed rollers 26, 26 and 26, and a rotary shaft 28, on which are mounted these large diameter feed rollers 26, 26 and 26. The rotary shaft 24 of the small diameter feed roller row and the rotary shaft 28 of the large diameter feed roller row are rotatably mounted at opposite ends thereof on arms 30 and 32. Consequently, it follows that the rollers 22 and 26 are rotatably mounted on the arms 30 and 32. Further, mounted at the center portions of the arms 30 and 32 is a connecting rod 34. Consequently, it follows that the arms 30 and 32 are connected to each other through the connecting rod 34. As shown in FIG. 1, the rotary shaft 24 is mounted on the arms 30 and 32 in parallel to the rotary shaft 28, and further, the connecting rod 34 is mounted on the arms 30 and 32 in parallel to these rotary shafts 24 and 28. A pair of feed roller assemblies identical with each other are parallelly arranged as shown.

Figure 2:
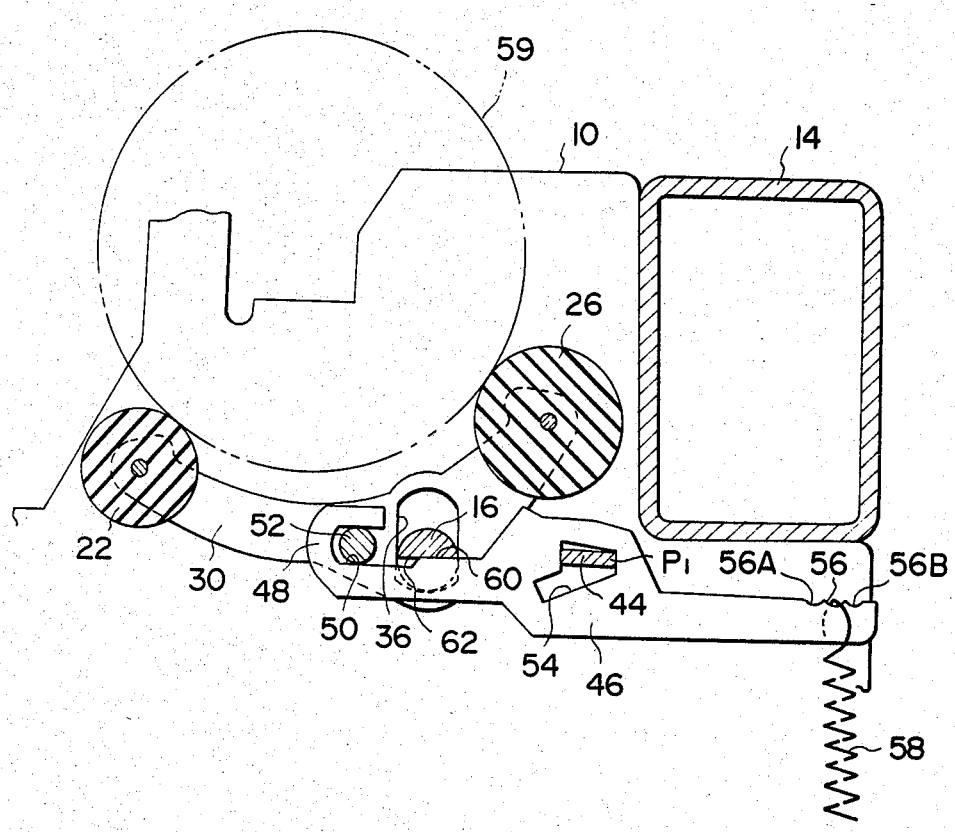
FIG. 2 is an enlarged sectional view taken along the line II—II in FIG. 1, showing the state where the feed rollers are set in this embodiment.

FIG. 2 is an enlarged sectional view taken along the line II—II in FIG. 1. As shown in FIG. 2, the arm 30 is formed with a slot 36, through which a working rod 16 is inserted. Consequently, it follows that the arm 30 is supported by the working rod 16. The other arm 32 is also formed with a slot 36, through which the working rod 16 is inserted to support the arm 32.

As shown in FIG. 1, a support bracket 38 is solidly secured to the bottom surface of the pipe frame 14. As shown in FIG. 1, a projected member 40 is formed at the central portion of the support bracket 38 and the aforesaid working rod 16 extends through a hole 42 formed in this projected member 40. Further, the support bracket 38 is provided at opposite ends thereof with projections 44 and 44. Rocking levers 46 and 46 are disposed at the central portions in the axial directions of the feed roller assemblies 18 and 20, respectively. As shown in FIG. 2, the rocking lever 46 is bent at one end 48 thereof into a U-shape to form a groove 50, through which is inserted a small diameter portion 52 formed at the central portion in the axial direction of the connecting rod 34. Consequently, it follows that one end 48 of the rocking lever 46 is rotatably supported by the connecting rod 34. Further, an opening 54 is formed at the central portion of the rocking lever 46, and the projection 44 of the support bracket 38 is inserted through the opening 54, so that the rocking lever 46 can rock about a point $P_1$ of the projection 44. Formed at the other end of the rocking lever 46 is a recess 56, with which is engaged one end of a spring 58, the other end of which is solidly secured to the frame, not shown. The spring 58 urges the rocking lever 46 about the point $P_1$ in the clockwise direction. Consequently, it follows that the arm 30 connected to the rocking lever 46 through the small diameter portion 52 of the connecting rod 34 is urged by the resiliency of the spring 58 toward the platen 59. Other recesses 56A and 56B are formed at both sides of the recess 56, with which one end of the spring 58 is engaged, so that the positions to be engaged with the spring 58 can be changed to adjust the urging force in value to be applied to the rocking lever 46.

Figure 3:
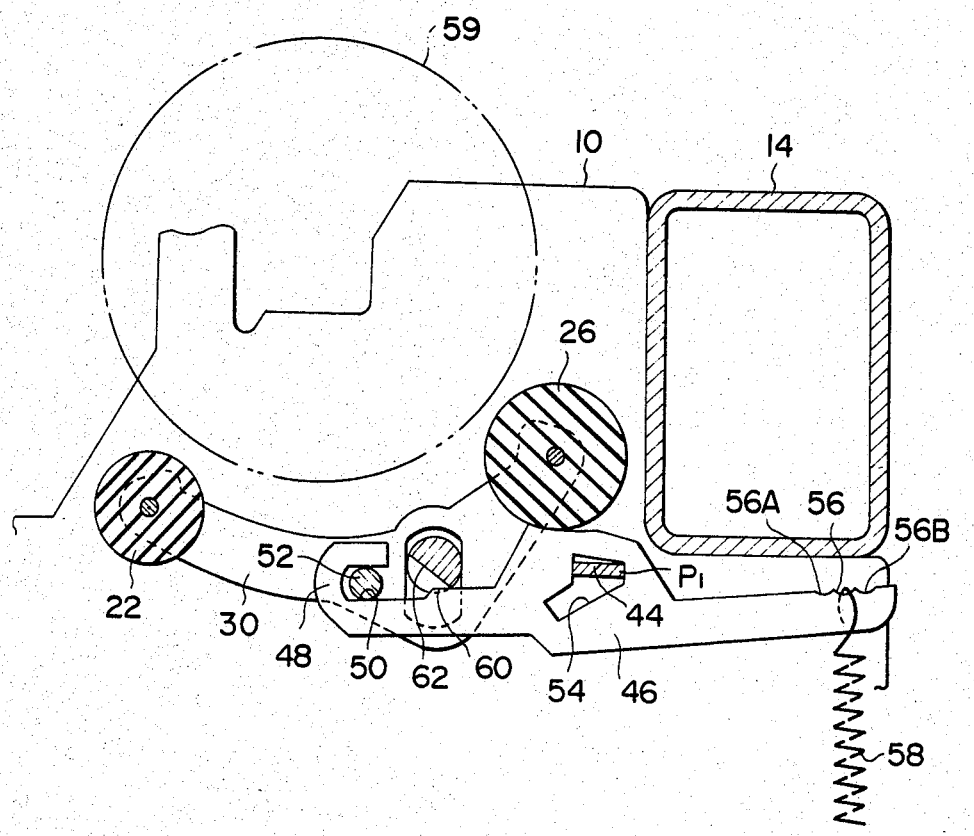
FIG. 3 is an enlarged sectional view showing the state where the feed rollers are set in this embodiment.

As shown in FIG. 2, the working rod 16 is provided at the side thereof opposed to the upper edge portion 60 of the rocking lever 46 with a flat cut surface 62. Consequently, if the working rod 16 is turned as shown in FIG. 3, than a corner of the cut surface 62 of the working rod 16 abuts against the upper edge portion 60 of the rocking lever 46, whereby the rocking lever 46 is pressed down and rotate about the point $P_1$ against the urging force of the spring 58 as shown in FIG. 3, so that the feed rollers 22 and 26 leave the platen 59 to bring about the setoff state.

Figure 4:
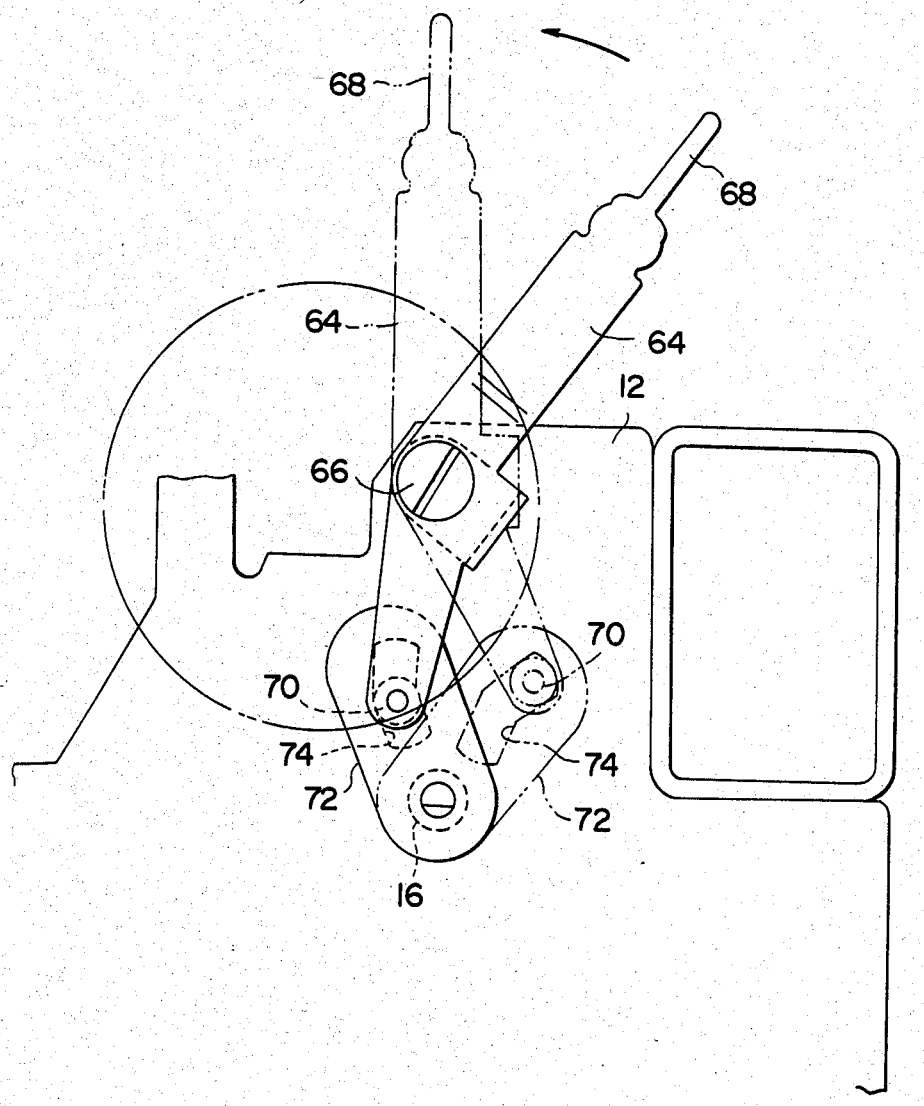
FIG. 4 is an enlarged view in the direction indicated by the arrows from the line IV—IV in FIG. 1.

Description will now be given of a turning mechanism of the working rod 16 with reference to FIG. 4. As shown in FIG. 4, a bent control lever 64 is mounted on the side frame in a manner to be rotatable about a pin 66. A grip portion 68 is formed at the upper end portion of the lever 64, and secured to the lower end portion thereof with a pin 70. Solidly secured to the end portion of the working rod 16 at the side of the side frame 12 as shown in FIG. 4 is the lower end portion of a link 72, in which a bent groove 74 is formed from the central portion to the upper portion thereof. Inserted through this groove 74 is the pin 70 secured to the lower end portion of the aforesaid lever 64. Consequently, when the lever 64 and the link 72 are at positions indicated by solid lines, the cut surface 62 of the working rod 16 solidly secured to the link 72 is at a position where the cut surface 62 is spaced apart from and opposed to the upper edge portion 60 of the rocking lever 46 as shown in FIG. 2. On the other hand, when the lever 46 is rotated about the pin 66 in the counterclockwise direction (in a direction indicated by an arrow in FIG. 4) and moves to a position indicated by a two-dot chain line in the drawing, the link 72 is rocked about the working rod 16 in the clockwise direction, and, in the working rod 16, as shown in FIG. 3, the cut surface 62 is inclined to press down the upper edge portion 60 of the rocking lever 46 against the urging force of the spring 58. At this time, the pin 70 secured to the lower end portion of the lever 64 slides in the groove 74 formed in the link 72 and moves to a position indicated by a two-dot chain line. The groove 74 of the link 72 is bent at this position of the pin 70 indicated by the two-dot chain line, whereby the pin 70 is engaged with the upper portion of the groove 74 as indicated by the two-dot chain line. Consequently, under this condition, the feed rollers are held in the setoff state.

Description will hereunder be given of action of the embodiment of the present invention with the abovedescribed arrangement. To set a sheet of paper in the typewriter, it is necessary to set the feed rollers off the platen. This action is performed by moving the lever 64 shown in FIG. 4 from a position indicated by a solid line to a position indicated by a two-dot chain line. In other words, if the lever 64 is moved to the position indicated by the two-dot chain line in FIG. 4, then, as described above, the working rod 16 turns, the corner of the cut surface 62 of the working rod 16 urges the upper edge portion 60 of the rocking lever 46, presses down the rocking lever 46 against the urging force of the spring 58, and sets the feed rollers 22 and 26 off the platen 59. Under this condition, the feed rollers are in the setoff state, so that a sheet of paper can be set in the typewriter. Subsequently, to enter the printing work of the typewriter, if the lever 64 shown in FIG. 4 is moved from the position indicated by the two-dot chain line to the position indicated by the solid line, then the working rod 16 turns to the position shown in FIG. 2, and the cut surface 62 leaves the upper edge portion 60 of the rocking lever 46, whereby the feed rollers 22 and 26 are urged by the urging force of the spring 58 toward the platen 59.

In the abovedescribed embodiment, the rocking levers 46 are disposed at the central portions of the feed roller assemblies 18 and 20 in the axial lines respectively, to urge the feed rollers 22 and 26 against the platen, so that the feed rollers can be urged against the platen 59 by the forces in uniform value. Since the springs for urging the feed rollers 22 and 26 against the platen 59 are provided on only two rocking levers 46, both springs can be easily adjusted in spring pressure. Further, the mechanism for setting the feed rollers off the platen is of such an arrangement that flat cut surface 62 are formed on the working rod 16, and this cut surfaces 62 are adapted to press down the rocking levers 46 which urge the feed rollers 22 and 26 toward the platen 59, so that the mechanism for setting the feed rollers off the platen can be simplified in construction to a considerable extent. Further the two pairs of arms 30 and 32 are identical in configuration with one another, whereby all of these arms are manufactured in one die by press work, so that dimensional errors therebetween occurring during manufacture can be minimized, thereby enabling to make the urging forces of the feed rollers 22 and 26 against the platen 59 uniform. The abovedescribed case of the arms 30 and 32 is true of the case of the pair of rocking arms and the latter can also manufactured in one die, so that dimensional errors therebetween occurring during manufacture can be minimized.

As has been described hereinabove, with the feed rollers of the typewriter according to the present invention, the rocking levers are provided at the central portions of the pair of feed roller assemblies in the axial direction of the platen, and the springs for uging the feed rollers against the platen are provided on the rocking levers respectively, so that the adjustment of the respective feed rollers in urging force can be facilitated, and moreover, the working rod is formed thereon with the flat surfaces, the corners of which are adapted to urge down the upper edge portions of the rocking levers, whereby the feed rollers are set off the platen against the urging forces of the springs, so that the mechanism for setting the feed rollers off the platen can be simplified in construction.

What is claimed is:

1. In a typewriter having a platen pivotally supported on a typewriter frame and a feed roller device for pressing a paper to the platen, said feed roller device comprising:

a pair of feed roller assemblies arranged in parallel to an axial direction of said platen, and a working rod pivotally supported in parallel to the platen on the typewriter frame, having a round surface and a flat surface causing the feed roller assemblies to approach and recede from the platen, each of the feed roller assemblies including:

a first feed roller row having a plurality of feed rollers arranged on a first rotary shaft, a second feed roller row having a plurality of feed rollers arranged on a second rotary shaft in parallel to said first rotary shaft, arms pivotally supporting opposite ends of the first and second rotary shafts, each of said arms having an opening longitudinally extending toward said platen, said working rod extending through said opening and contacting an inner surface of said opening a connecting rod arranged in parallel to the first and second rotary shafts, ends of said connectings rod being connected to said arms, and a rocking lever rockingly supported on the typewriter frame, one end of each of which being pivotally supported on said connecting rod at the central portion in the axial direction of each of the feed roller assemblies, the other end of which being connected to a single resilient member for urging each of said said feed roller assemblies toward the platen, said rocking lever being provided for each of the feed roller assemblies and having a surface abutting said flat surface of said working rod, whereby when said working rod is rotated in such direction that said rocking lever is rocked against a resilient force of the resilient member, said arms are displaced such direction that said feed roller assemblies recede from the platen, and when said working rod is rotated in such direction that said working rod is rocked by means of said resilient force, said arms are displaced in such direction that said feed assemblies approach the platen.

2. A feed roller device of a typewriter as set forth in claim 1, wherein each of said openings is an oblong hole whose diameter in a lateral direction which is transverse to the longitudinal direction of said opening corresponds to the diameter of said round shape of said working rods so that no movement of the arms in the lateral direction of the oblong hole is effected with displacement of the arms in a longitudinal direction of the oblong hole while said oblong hole is in contact with the round surface of said working rod.

3. A feed roller device of a typewriter as set forth in claim 1, wherein said rocking lever is provided thereon with a plurality of engageable portions and said resilient member is engageable with one of said plurality of engageable portions of said rocking levers.

4. A feed roller device of a typewriter as set forth in claim 1, wherein said typewriter frame comprises two side frames for rotatably supporting said working rod and wherein said two side frames, each of said arms and each of said rocking levers, all of which are included in a typewriter, can be manufactured in the same dies, respectively, by press work.

* * * * *